United States Patent [19]

Saito et al.

[11] Patent Number: 4,914,867

[45] Date of Patent: Apr. 10, 1990

[54] APPARATUS FOR PROCESSING END FACE OPTICAL FIBER CONNECTOR

[75] Inventors: Kazuharu Saito, Nagano; Junji Watanabe, Tokyo; Tadao Saitoh, Tokyo; Kazuo Matsunaga, Tokyo, all of Japan

[73] Assignees: Kabushiki Kaisha Sankyo Seiki Seisakushi, Nagano; Nippon Telegraph and Telephone Corp., Tokyo, both of Japan

[21] Appl. No.: 318,407

[22] Filed: Mar. 3, 1989

[30] Foreign Application Priority Data

Mar. 4, 1988 [JP] Japan ..... 63-49494

[51] Int. Cl.[4] ..... B24B 5/32

[52] U.S. Cl. ..... 51/134; 51/237 T; 51/3

[58] Field of Search ..... 51/134, 131.1, 283 R, 51/237 T, 3, 131.3

[56] References Cited

U.S. PATENT DOCUMENTS

| | | | |
|---|---|---|---|
| 57,471 | 8/1866 | Caperrell | 51/134 |
| 1,708,569 | 4/1929 | Fotheringham | 51/237 T |
| 1,833,329 | 11/1931 | Packer | 51/237 T |
| 2,622,375 | 12/1952 | Haas et al. | 51/237 T |
| 2,649,668 | 8/1953 | Zinn et al. | 51/237 T |

*Primary Examiner*—Robert A. Rose

*Attorney, Agent, or Firm*—Sughrue, Mion, Zinn, Macpeak & Seas

[57] ABSTRACT

Apparatus for processing an end face of an optical fiber connector includes a rotatable index shaft mounted on a frame. A plurality of rotatable chucks are mounted on the index shaft so as to hold optical fiber connectors, respectively. In accordance with the rotation of the index shaft, the chucks can be moved sequentially from one index position to another so as to grind and finish the optical fiber connector. A rotatable drive gear is disposed coaxially with the index shaft. A driven gear is fixedly mounted on each chuck. A pair of first and second intermediate gears are connected to the drive and driven gears, respectively. A clutch is interposed between the pair of intermediate gears and normally connecting them together to transmit the rotation of the drive gear to the driven gear to rotate each chuck. A clutch disengagement device is provided for disengaging the clutch to disconnect the two intermediate gears when each chuck is indexed to a position where the optical fiber connector is attached to and detached from the chuck.

11 Claims, 9 Drawing Sheets

APPARATUS FOR PROCESSING END FACE OPTICAL FIBER CONNECTOR

BACKGROUND OF THE INVENTION

1. Field of the Invention

This invention relates to an apparatus for continuously carrying out the grinding and finishing operations of end faces of optical fiber connectors by rotation-indexing.

2. Prior Art

Apparatus for grinding and polishing end faces of optical fiber connectors is disclosed in Japanese Laid-Open (Kokai) Patent Application Nos. 228061/85 and 228062/85. In such conventional apparatus, the processing steps, that is, the grinding and the polishing, are carried out using a swinging arm, and therefore such apparatus can not effect a continuous processing. In addition, a plurality of optical fiber connectors are mounted on the swinging arm in fixed relation relative to the swinging arm. Therefore, the end face of the optical fiber connector can not be processed into a convex shape. Further, since a continuous processing operation can not be carried out, much time is required for attaching and detaching the optical fiber connectors relative to the swinging arm and also for changing the processing steps. When one processing step is being carried out, another step can not be carried out at the same time. Thus, this is not desirable from the viewpoint of efficiency.

SUMMARY OF THE INVENTION

It is therefore an object of this invention to provide an apparatus for processing an end face of an optical fiber connector which is simpler in construction by the use of a rotary index mechanism, and is reliable in operation, and facilitates the attachment and detachment of the optical fiber connector relative to a chuck.

According to the present invention, there is provided an apparatus for processing an end face of an optical fiber connector comprising:

(a) a rotatable index shaft mounted on a frame;

(b) a mounting-reference member disposed at a first index position for providing a reference for mounting the optical fiber connector;

(c) a grinding unit disposed at a second index position for grinding the end face of the optical fiber connector;

(d) a finishing unit disposed at a third index position for finishing the end face of the optical fiber connector;

(e) a plurality of chucks for holding optical fiber connectors, respectively, said chucks being mounted on said index shaft so that each chuck can be moved sequentially from one of said indexed positions to another, and each said chuck being rotatable together with the optical fiber connector;

(f) a rotatable drive gear disposed coaxially with said index shaft;

(g) a driven gear fixedly mounted on each said chuck;

(h) a pair of first and second intermediate gears connected to said drive and driven gears, respectively;

(i) a clutch means interposed between said pair of intermediate gears and normally connecting them together to transmit the rotation of said drive gear to said driven gear to rotate said each chuck; and (j) a clutch disengagement means for disengaging said clutch means to disconnect said two intermediate gears when said each chuck is indexed to said first index position.

Because of the provision of the clutch disengagement means, each chuck is not rotated about its axis when the chuck is disposed at the first index position where the optical fiber connector is attached to or removed from the chuck. Therefore, the optical fiber connector can be easily attached to and removed from the chuck at the first index position. Further, the driving rotation is transmitted to each chuck through the gear train from the center of the rotatable index shaft, and therefore the speed of rotation of the chuck will not fluctuate as is the case with the prior art employing a frictional rotation-transmitting means. This enhances the precision of the processed end face of the optical fiber connector.

BRIEF DESCRIPTION OF THE INVENTION

Figure 8:
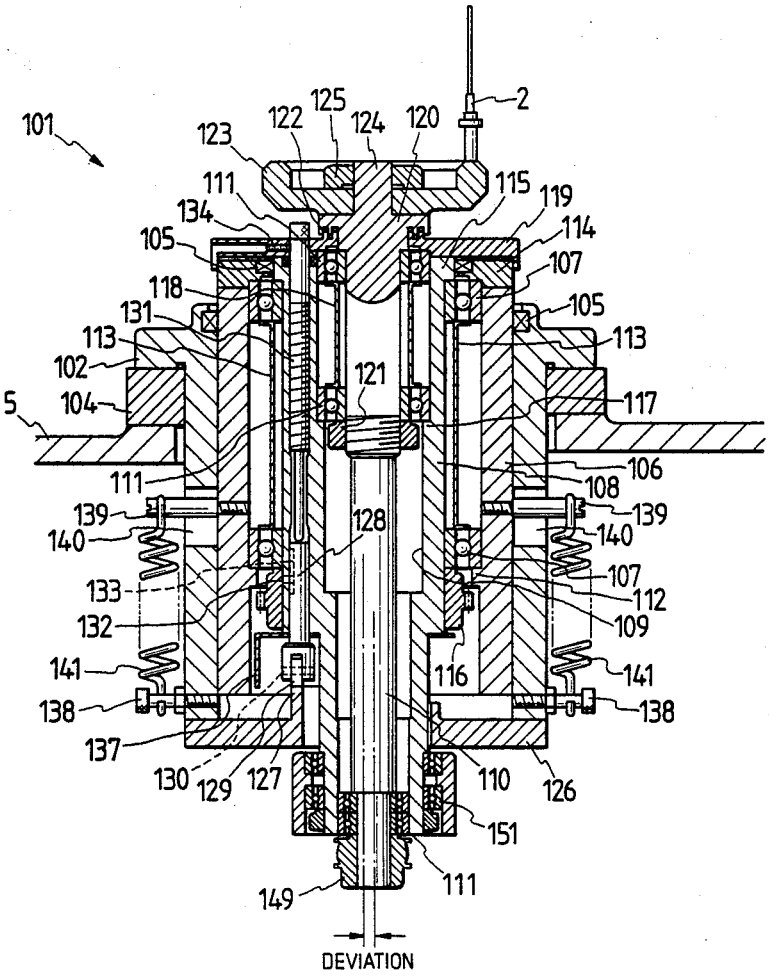
Figure 9:
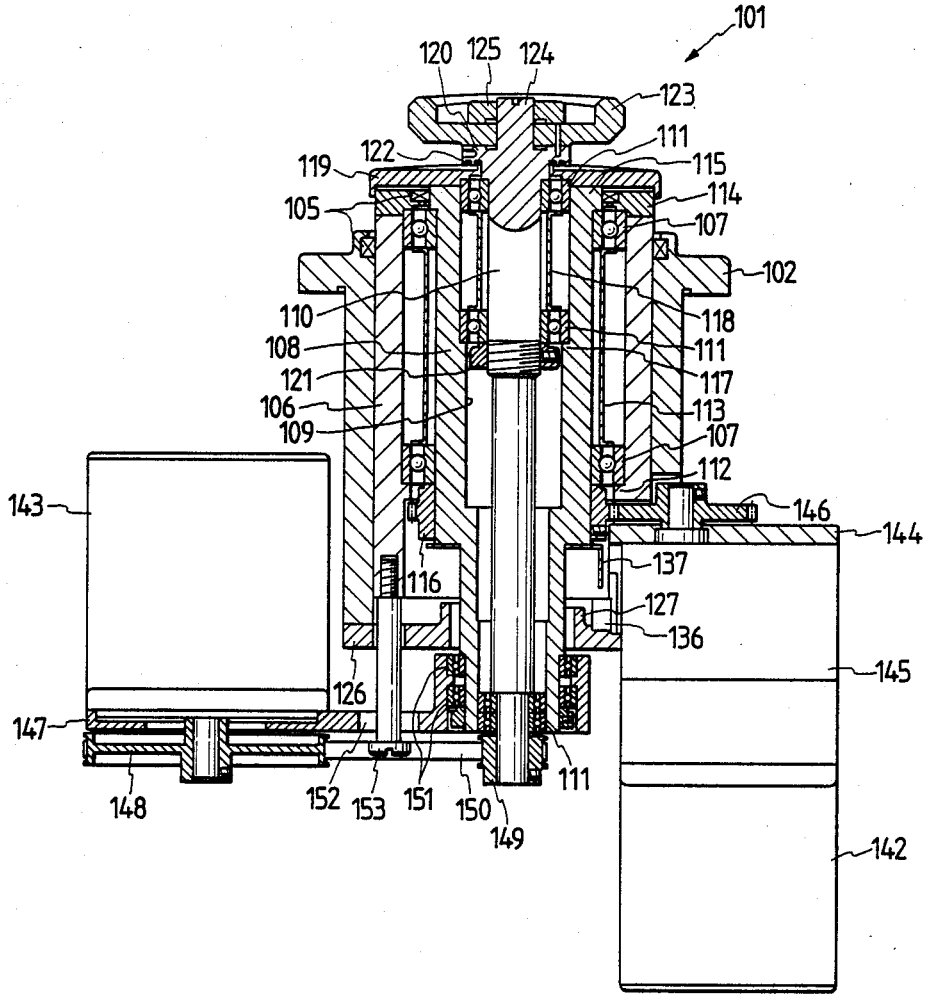
Figure 10:
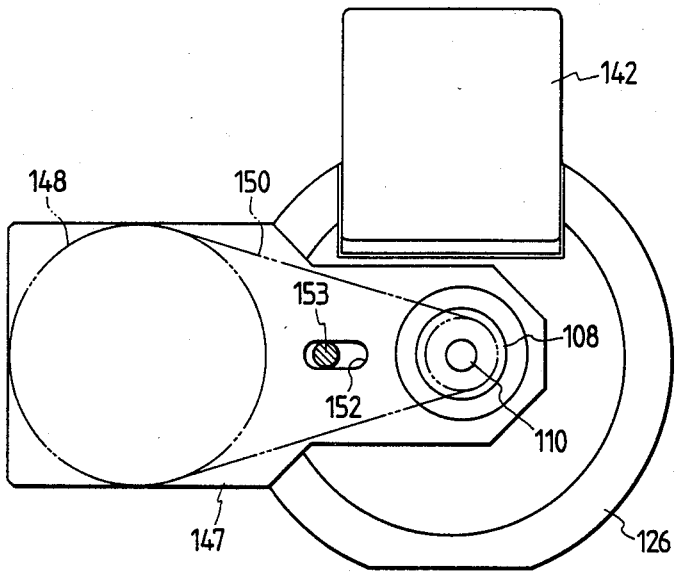
Figure 11:
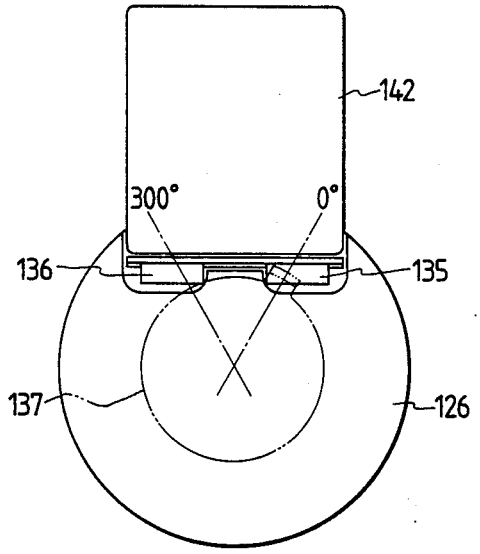
Figure 12:
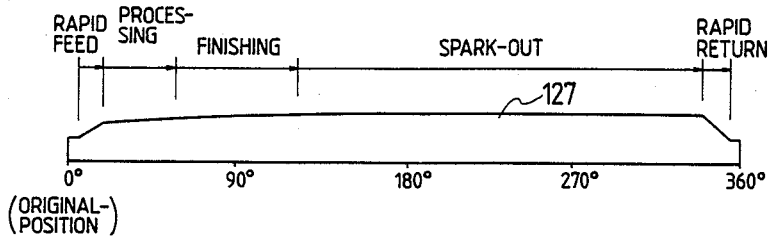
Figure 13:
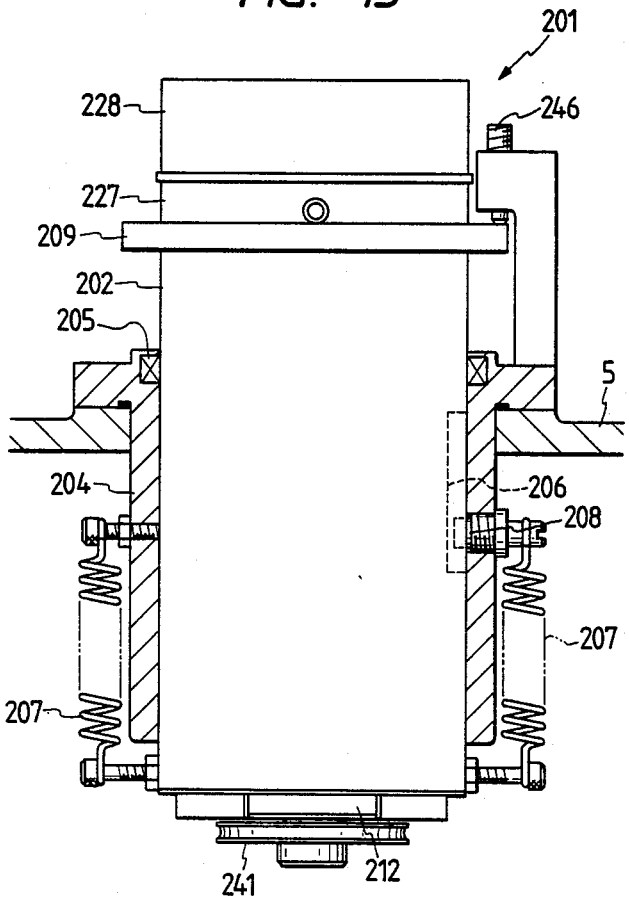
Figure 14:
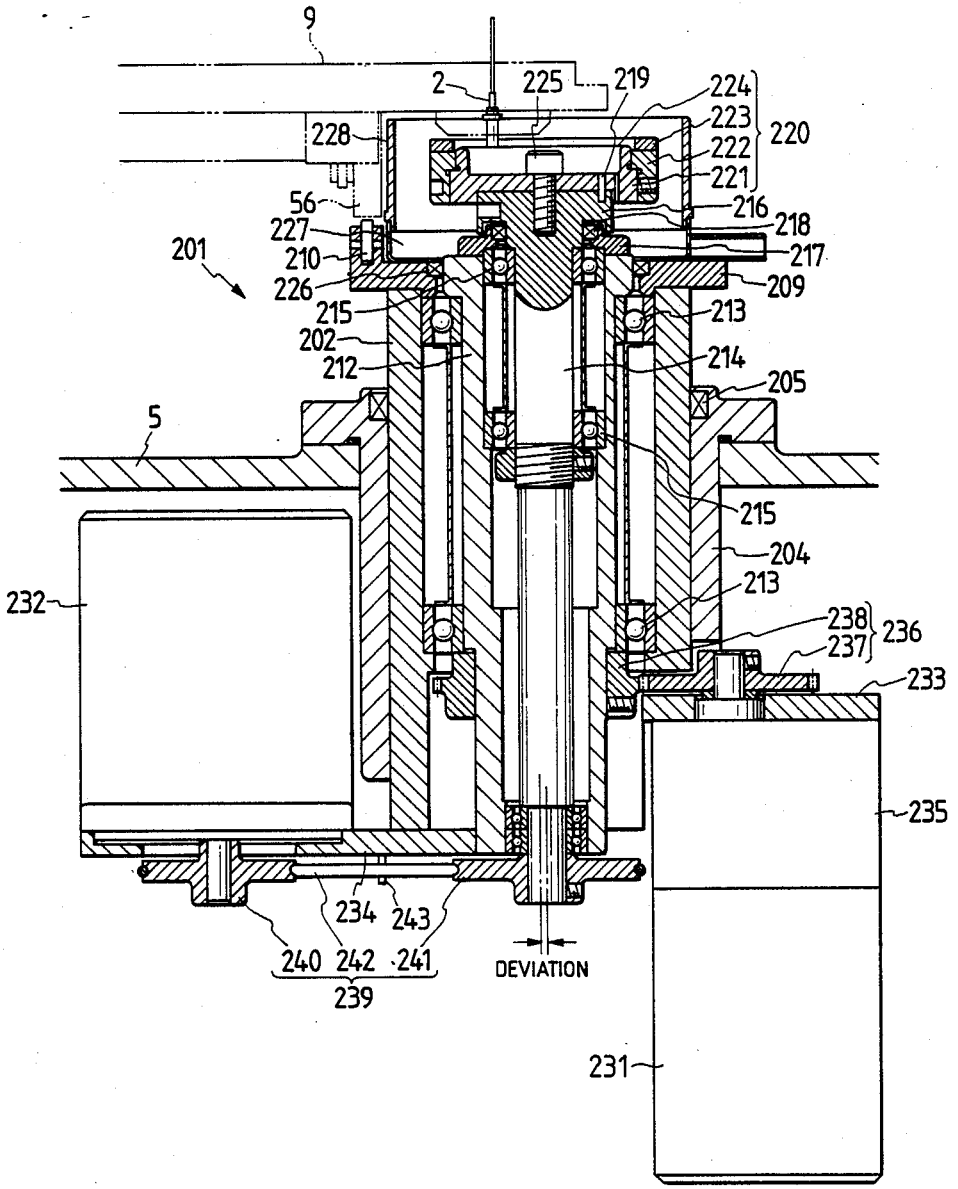
Figure 15:
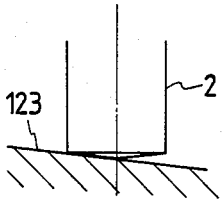
Figure 16:
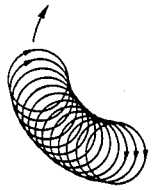
Figure 17:
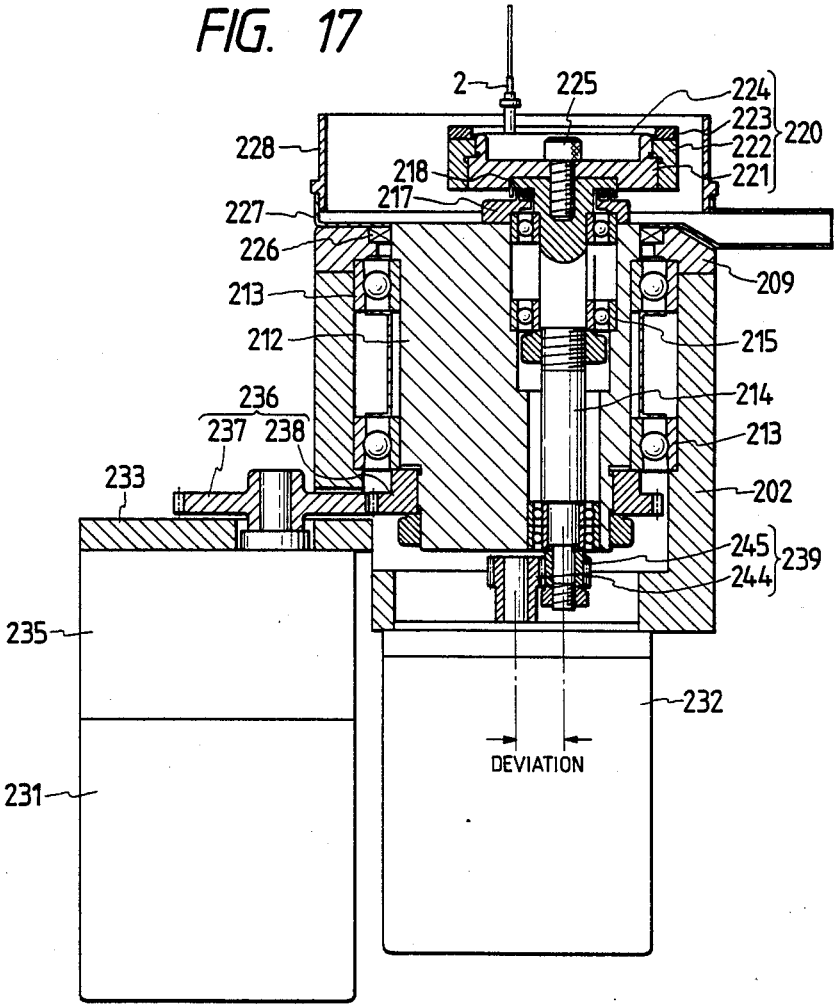

FIGS. 7(A) to 7(D) are views showing mounting portions for mounting a dial gauge and a descending jig;

FIG. 8 is an enlarged vertical cross-sectional view of a grinding unit;

FIG. 9 is an enlarged vertical cross-sectional view of the grinding unit as viewed in a different direction;

FIG. 10 is an enlarged plan view of a motor-mounting member;

FIG. 11 is an enlarged plan view of an original-position sensor and a dog;

FIG. 12 is a developed, side-elevational view of a stationary cam;

FIG. 13 is an enlarged cross-sectional view of the portion of the apparatus where a finishing unit is mounted;

FIG. 14 is an enlarged vertical cross-sectional view of the finishing unit;

FIG. 15 is an enlarged view showing a grinding element in contact with an end face of an optical fiber connector;

FIG. 16 is an illustration showing a plane in which a relative movement between the optical fiber connector and a polishing film is carried out; and FIG. 17 is an enlarged vertical cross-sectional view of a modified finishing unit.

DESCRIPTION OF THE PREFERRED EMBODIMENTS OF THE INVENTION

Figure 1:
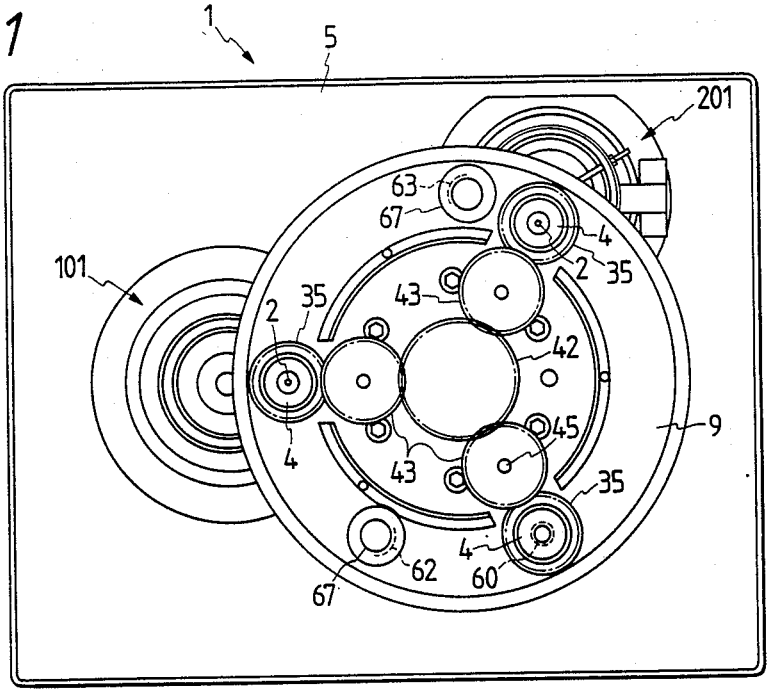
FIG. 1 is a top plan view of an apparatus for processing an end face of an optical fiber connector provided in accordance with the present invention.
Figure 2:
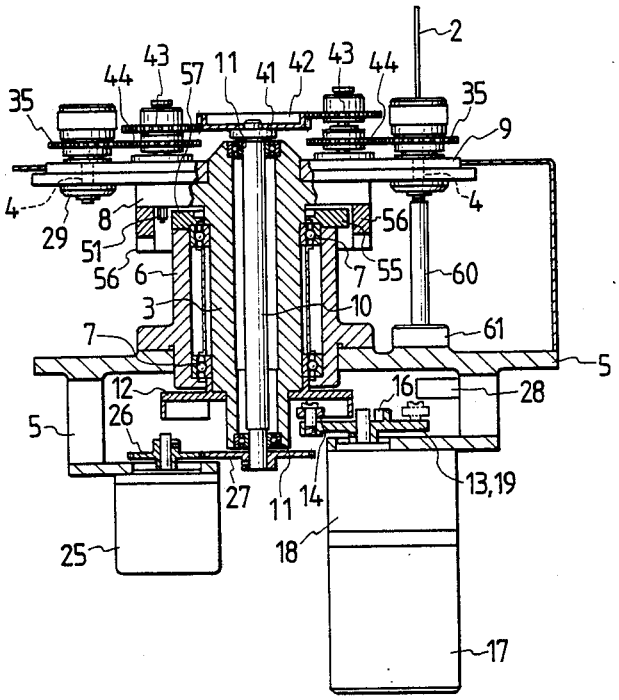
FIG. 2 is a vertical cross-sectional view of the apparatus.

FIGS. 1 and 2 show an apparatus 1 for processing an end face of an optical fiber connector, provided in accordance with the present invention. The apparatus 1 comprises three chucks 4 arranged around a rotary index shaft 3, each of the chucks 4 being rotatable abut its axis. Optical fiber connectors 2 are adapted to be held by the chucks 4, respectively. The rotary index shaft 3 is rotatable about its axis so as to index the chucks 4 at three different positions spaced an angle of 120 degrees from one another. More specifically, the rotary index shaft 3 is of a hollow construction and is supported by a pair of upper and lower bearings 7 mounted on an inner peripheral surface of a tubular support member 6 mounted on a horizontal frame 5, so that the rotary index shaft 3 is rotatable about its axis disposed vertically. The index shaft 3 has a mounting flange 8 adjacent to its upper end, and a disc-shaped index plate 9 is supported on the mounting flange 9 for rotation with the index shaft 3. A transmission shaft 10 extends through the bore of the hollow index shaft 3 in coaxial relation thereto, the transmission shaft 10 being supported by a pair of upper and lower bearings 11 and 11 mounted on the inner surface of the index shaft 3.

Figure 3:
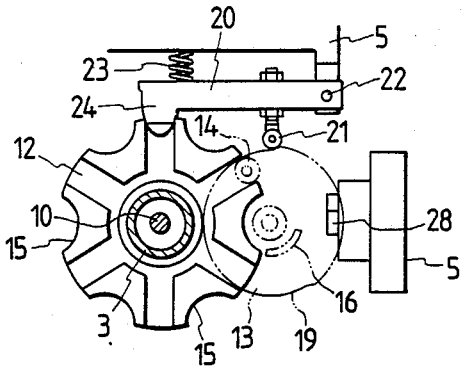
FIG. 3 is a plan view of an indexing mechanism of the apparatus.

A Geneva wheel 12 is fixedly mounted on the lower portion of the rotary index shaft 3, and a gear 27 is fixedly mounted on the lower end of the transmission shaft 10. The Geneva wheel 12 can be indexed to six discrete positions during one rotation of the wheel 12. The rotation of an index motor 17 is reduced by a speed reducer 18 and is transmitted to the Geneva wheel 12 via a Geneva drive plate 13 and a roller 14 mounted on the plate 13, as shown in FIGS. 2 and 3. The arcuate recesses 15 in the Geneva wheel 12 and an arcuate projection 16 on the Geneva drive plate 13 constitute a Geneva stop. To ensure the accurate positioning, the Geneva drive plate 3 has at its outer periphery a cam surface 19 with which a cam roller 21, carried by a positioning lever 20, is held in contact. The positioning lever 20 is pivotally connected at one end to the frame 5 by a pivot pin 22 disposed perpendicular to the frame 5, the positioning lever 20 being urged by a spring 23 toward the Geneva wheel 12 so that a projection 24 on the other end of the positioning lever 20 can be fitted in a selected one of grooves in the Geneva wheel 12, as shown in FIG. 3, to thereby positively hold the Geneva wheel 12 in the selected indexed position. The rotation of a reversible motor 25 for reciprocally rotating the optical fiber connectors 2 is transmitted to the transmission shaft 10 via gears 26 and 27. The amount of rotation of the Geneva drive plate 13 is detected by an index sensor 28 mounted on the frame 5. The motors 17 and 25 and the speed reducer 18 are mounted on the lower portion of the frame 5.

Figure 4:
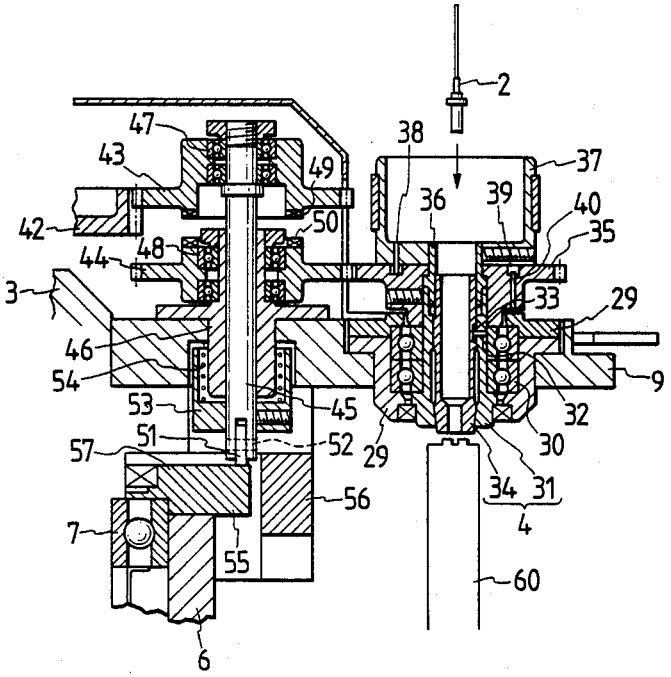
FIG. 4 is an enlarged cross-sectional view of the portion of the apparatus where a clutch is mounted.

The three chucks 4 are mounted on the index plate 9 and disposed in a circle in such a manner that the three chucks 4 are circumferentially spaced an angle of 120 degrees from one another with respect to the center of the index plate 9. As shown in FIG. 4, each chuck 4 is rotatably supported within a housing, constituted by upper and lower housing elements 29, through a pair of upper and lower bearings 30, so that each chuck 4 is rotatable about its axis disposed vertically. More specifically, the chuck 4 is, for example, of the collet type and comprises a collet sleeve 31 rotatably supported by the bearings 30, and a collet 34 received coaxially in the collet sleeve 31 for vertical axial sliding movement therealong. The rotation of the collet 34 relative to the collet sleeve 31 is prevented by a pin 32 which is mounted on the collet sleeve 31 and is received in a longitudinal groove 33 formed in the outer peripheral surface of the collet 34. The collet sleeve 31 is fixed secured at its upper end to a driven gear 35, and the collet 34 has an externally-threaded upper portion which is threaded into an internally-threaded bore of a lock nut 36. The lock nut 36 is rotatable relative to the driven gear 35 and is connected at its upper end portion to a thumb piece 37 for manipulating the chuck 4. The amount of rotation of the thumb piece 37 is limited to within one rotation thereof. More specifically, a pin 38 secured to the bottom of the thumb piece 37 is received in a groove 39, formed in the upper surface of the driven gear 35, for movement therealong, and is adapted to be brought into engagement with a stop pin 40 extending into the groove 39, thereby limiting the rotation of the thumb piece 37.

Figure 5:
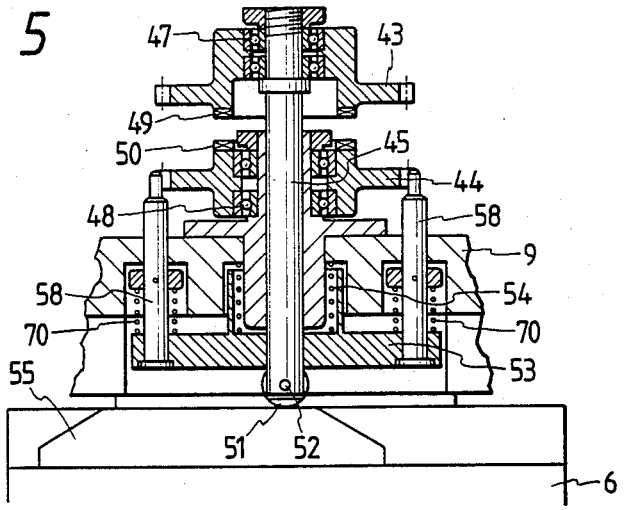
FIG. 5 is an enlarged cross-sectional view of the portion of the apparatus where a chuck is mounted.

A drive gear 42 is fixedly mounted on a mounting flange 41 formed on the upper end of the transmission shaft 10. Three pairs of opposed upper and lower intermediate gears 43 and 44 are arranged adjacent to the three chucks 4, respectively, so as to impart more than one to less than two reciprocal rotations to the chucks 4. The drive gear 42 is in mesh with the upper intermediate gears 43. As shown in FIGS. 4 and 5, the upper intermediate gear 43 is rotatably mounted on an upper end of a clutch shaft 45 through bearings 47, and the lower intermediate gear 44 is rotatably mounted through bearings 48 on a tubular bearing holder 46 fixedly mounted on the frame 5. The upper and lower gears 43 and 44 have clutchs 49 and 50, for example, of the dog type, formed integrally at their opposed surfaces, respectively. The clutch shaft 45 is received in the bearing holder 46 for axial sliding movement therealong, and has a cam roller 51 rotatably mounted on its lower end by a pin 52, the cam roller 51 being rotatable in a direction tangential to the locus of rotation. A pin plate 53 is fixedly mounted on the lower portion of the clutch shaft 45, and a coil spring 54 acts between the index plate 9 and the pin plate 53 to normally urge the clutch shaft 45 downwardly so that the cam roller 51 is held against an upper surface of a first cam 55. The first cam 55 is formed on part of an upper surface of a bearing holder 57 adjacent to its outer periphery, the bearing holder 57 being fixedly secured to the upper end of the support member 6. The first cam 55 serves to move the clutch shaft 45 upwardly only at the portion thereof disposed near a mounting-reference member 60 disposed at an optical fiber connector-mounting and removal position. The clutch shaft 45 and the first cam 55 constitute a clutch disengagement means for disengaging the clutches 49 and 50 from each other. The mounting-reference member 60 is threaded at its lower end into the frame 5 and vertically disposed perpendicular thereto. The height of the mounting-reference member 60 can be suitably adjusted by a lock nut 61. Rotation-preventing pins 58 are mounted on the opposite ends of the pin plate 53 for vertical sliding movement relative thereto and extend through the index plate 9, each of these pins 58 being urged upwardly by a spring 70 so that the pins 58 can extend between adjacent teeth of the intermediate gear 44.

Figure 6:
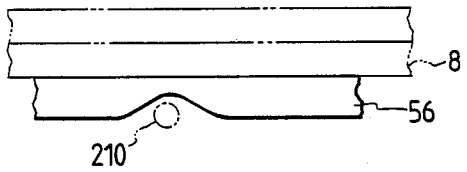
FIG. 6 is a developed view of a second cam.
Figures 7A, 7B, 7C, 7D:
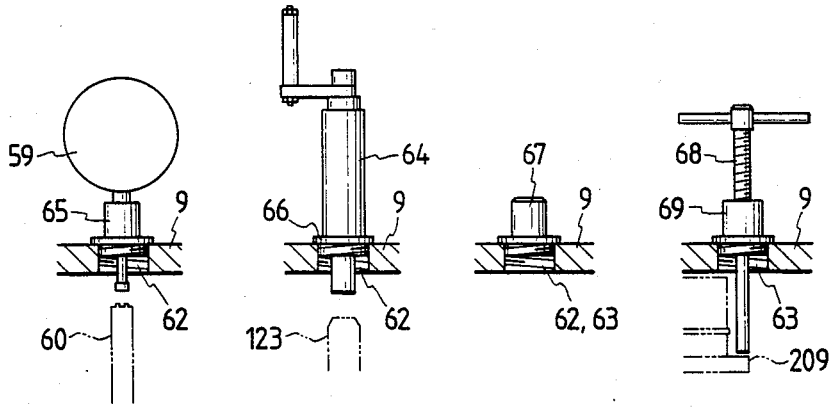

A second cam 56 is fixedly secured to the lower surface of the mounting flange 8 so as to rotate with the rotary index shaft 3. As shown in FIG. 6, the second cam 56 has recesses at those portions thereof corresponding respectively to the chucks 4 and an intermediate mounting portion 62 later described, the recesses being recessed upwardly.

In addition to the mounting-reference member 60, a grinding unit 101 and a finishing unit 201 is mounted on the frame 5. These three are spaced from one another at an angle of 120 degrees with respect to the center of the index plate 9 so as to correspond to the three chucks 4, respectively.

As shown in FIG. 1, the index plate 9 has the intermediate mounting portion 62 defined by a threaded hole and disposed between the two chucks 4. The index plate 9 also has a descending jig-mounting portion 63 defined by a threaded hole and disposed adjacent to the other chuck 4. A dial gauge 59 and a dresser 64 are adapted to be selectively attached to the intermediate mounting portion 62 through their respective mounting members 65 and 66 (FIG. 7). The dial gauge 59 and the dresser 64 can be adjusted in height by their respective mounting members 65 and 66. When either of the dial gauge 59 and the dresser 64 is not attached to the intermediate mounting portion 62, a plug 67 is attached thereto. A descending jig 68 is adapted to be attached to the descending jig mounting portion 63 through a mounting member 69.

FIGS. 8 to 11 shows the grinding unit 101. The grinding unit 101 is incorporated or contained in a fixed guide 102. More specifically, the fixed guide 102 is, for example, of a hollow cylindrical shape and is mounted relative to a mounting hole, formed through the horizontal frame 5, through an annular washer 104 tapering or decreasing in width progressively from one side thereof to the other so that the axis of the fixed guide 102 is inclined relative to the vertical axis. A tubular support member 106 is received in the fixed guide 102 for sliding movement therealong. Mounted in the inner surface of the fixed guide 102 is a seal ring 105 with which the outer periphery of the tubular support member 106 is disposed in sliding contact. A hollow shaft 108 is received coaxially in the tubular support member 106 and is supported thereby through upper and lower bearings 107 so that the hollow shaft 108 is rotatable about its axis, the hollow shaft 108 having an eccentric bore 109 extending axially therethrough, the eccentric bore 109 having a lower portion of a reduced diameter. An inner shaft 110 is axially received in the eccentric bore 109 of the hollow shaft 108 and is supported thereby through upper, intermediate and lower bearings 111 so that the inner shaft 110 is rotatable about its axis. With this arrangement, the axis of the inner shaft 110 is eccentric from the axis of the hollow shaft 108 by a predetermined amount of E1 (FIG. 8). The lower bearing 107 is seated on a bearing seat or shoulder 112 on the inner surface of the tubular support member 106, and a spacer 113 is mounted around the hollow shaft 108 and extends between the upper and lower bearings 107. A bearing holder 114 holding a seal ring 105*a* is fixedly secured to the upper end of the support member 106 to hold the upper bearing 107. Therefore, the upper and lower bearings 107 are fixed or held against movement relative to the support member 106. An upper flange 115 of the hollow shaft 108 is seated on the upper bearing 107, and a gear 116 also serving as a nut is mounted on the lower portion of the hollow shaft 108 and is held against the lower bearing 107, so that the hollow shaft 108 is prevented from axial movement relative to the support member 106. Similarly, the upper and intermediate bearings 111 are fixed or held against movement by a bearing seat 117 on the inner surface of the hollow shaft 108, a spacer 118 extending between these two bearings 111 and a bearing holder 119 fixed to the upper end of the hollow shaft 108. The inner shaft 110 is prevented from axial movement relative to the bearings 111 by its upper flange 120 and a retainer nut 121 threaded on the inner shaft 110 intermediate opposite ends thereof. The lower surface of the upper flange 120 cooperates with the bearing holder 119 to form a labyrinth seal 122, and a cup-shaped grinding element 123 is fitted on a threaded upper end 124 of the inner shaft 110 and held against the upper surface of the upper flange 120. A nut 125 is screwed on the threaded upper end 124 to fix the grinding element 123 relative to the inner shaft 110.

The lower end of the fixed guide 102 is closed by a cam plate 126 which has a central hole therethrough through which the hollow shaft 108 extends downwardly. The cam plate 126 has an upwardly-extending stationary cam 127 of an annular shape integrally formed on the upper surface thereof around the edge of the central hole. The stationary cam 127 does not interfere with the rotation of the hollow shaft 108. As shown in FIG. 12 illustrating the development of the stationary cam 127, this cam 127 has a cam profile or contour of a predetermined gradient for effecting a rapid feed, a processing, a finishing, a spark-out and a rapid return within a rotation angle of 360 degrees. A cam roller 129, mounted on a lower end of a shaft 128 by a horizontal pin 130, is held in contact with the upper cam edge of the stationary cam 127.

The shaft 128 as well as a fixed shaft 131 is received in an axial hole formed through a thickened portion of the hollow shaft 108, the shaft 128 being movable along this axial hole. A rotation-preventing pin 132 is mounted on the hollow shaft 108 and is received in a longitudinal groove 133 formed in the outer peripheral surface of the shaft 128 so that the shaft 108 is prevented from angular movement. The fixed shaft 131 has an externally-threaded portion which is engaged with an internally-threaded portion of the above axial hole formed through the thickened portion of the hollow shaft 108. The fixed shaft 131 is adjustably held at a suitable position by a set screw 134 which is threaded into a radial hole in the bearing holder 119 and engaged with the fixed shaft 131. The support member 106 is urged downwardly by springs 141 each extending between upper and lower spring retainers 139 and 138, the spring retainer 138 being threadedly connected to the peripheral wall of the fixed guide 102 while the spring retainer 139 passes through a longitudinal slot 140 in the fixed guide 102 and is threadedly connected to the peripheral wall of the support member 106. Thus, the support member 106 is urged downwardly so that the cam roller 129 is always held in contact with the upper edge of the stationary cam 127.

An original-position sensor 135 and a height-adjusting position sensor 136 are fixedly mounted on the upper surface of the cam plate 126. The original-position sensor 135 is so disposed as to correspond to the rotation angle of 0° while the height-adjusting position sensor 136 is so disposed as to correspond to the position of the spark-out (for example, the rotation angle of 270°). These two sensors are so disposed as to correspond to a dog 137 mounted on the lower portion of the hollow shaft 108.

The grinding unit 101 incorporates a revolution-imparting motor 142 and an axial rotation-imparting motor 143. The motor 142 as well as a speed reducer 145 is mounted on a motor-mounting plate 144 formed integral with the fixed guide 102. A gear 146 connected to the output of the speed reducer 145 is in mesh with the gear 116 mounted around the hollow shaft 108. The motor 143 is mounted on a motor-mounting member 147, with its output shaft directed downwardly. A pulley 148 of a greater diameter is connected to the output of the motor 143, and a pulley 149 of a smaller diameter is fixedly mounted on the lower end of the inner shaft 110. A belt 150 extends around these two pulleys 148 and 149 so that the rotation of the motor 143 is transmitted to the inner shaft 110. The motor-mounting member 147 is connected to the lower end of the hollow shaft 108 through bearings 151 and is secured to the lower end of the support member 106 by a bolt 153 passing through a slot 152 and the cam plate 126 and threaded into the support member 106, the slot 152 being formed through the motor-mounting member 147. The bolt 153 is axially movable vertically relative to the cam plate 126 and serves to prevents the motor-mounting member 147 from revolving around the hollow shaft 108.

FIGS. 13 and 14 show the finishing unit 201. The finishing unit 201 is incorporated or contained in a frame 202. More specifically, the frame 202 is cylindrical and is received in a tubular fixed guide 204 for vertical sliding movement along the axis thereof, the fixed guide 204 being mounted on the frame 5. A seal ring 205 is mounted on the inner peripheral surface of the fixed guide 204 and held in sliding contact with the outer periphery of the frame 202. The frame 202 is urged upwardly by a plurality of springs 207 each connected between the lower end of the frame 202 and the portion of the fixed guide 204 disposed intermediate the opposite ends thereof. A pin 208 is secured to the fixed guide 204 and received in a longitudinal groove 206 formed in the outer peripheral surface of the frame 202, so that the frame 202 is prevented from angular movement relative to the fixed guide 204. The height of the frame 202 is adjusted or set by an abutment 246 (set screw) connected to the frame 5. A support plate 209 is secured to the upper end of the frame 202, and a roller 210 is mounted the support plate 209 adjacent to its outer edge and is held in contact with the lower edge of the cam 56 disposed at a predetermined height (FIG. 6), so that the upper movement of the frame 202 is limited by the cam 56. When the roller 210 is received in the recess in the cam 56, the support plate 209 is brought into engagement with the abutment 246.

A hollow shaft 212 is coaxially received in and rotatably supported by the frame 202 through upper and lower bearings 213 so that the hollow shaft 212 is rotatable about its axis. An inner shaft 214 extends through the axial bore of the hollow shaft 212 and is rotatably supported by the hollow shaft 212 through upper, intermediate and lower bearings 215, the inner shaft 214 being disposed in eccentric relation to the hollow shaft 212 in an amount of E2. The inner shaft 214 has at its upper end an integral mounting portion 216 which extends upwardly beyond the upper end of the hollow shaft 212 and holds an abrasive or polishing unit 220. A seal ring 218 is mounted around the inner shaft 214 and interposed between the mounting portion 216 and a bearing holder 217 mounted on the upper end of the hollow shaft 212.

The abrasive unit 220 comprises a body 221, a support ring 222 mounted around the body 221, and a holder ring 223. The body 221 has a dish-like shape and is fixedly secured to the upper surface of the mounting portion 216 by a screw 225. A pin 219 extends through the bottom of the body 221 into the mounting portion 216 to hold the body 221 against angular movement relative to the mounting portion 216. A polishing film 224 for finishing purposes is held between the support ring 222 and the holder ring 223, and the support ring 222 is threadedly connected to the body 221. With this arrangement, the polishing film 224 is held in contact with the annular upper edge of the body 221 under a sufficient tension to form a polishing surface. A seal ring 226 is interposed between the hollow shaft 212 and the support plate 209, and a pan 227 for receiving an abrasive liquid is mounted on the support plate 209, and a cover 228 integrally connected to the pan 227 surrounds the abrasive unit 220.

The frame 222 has at its lower end motor-mounting plates 233 and 234 on which first and second motors 231 and 232 are mounted, respectively. The first motor 231 drives the hollow shaft 212 for rotation so as to revolve the inner shaft 214 along a circular path (i.e., around the axis of the hollow shaft 212), the first motor 231 being mounted on the mounting plate 233 together with a speed reducer 235. A gear 237 is connected to the output of the speed reducer 235 and is in mesh with a gear 238 mounted around the hollow shaft 212. Thus, the first motor 231 drives the hollow shaft 212 for rotation at a relatively low speed through a rotation-transmission means 236 constituted by the two gears 237 and 238. The second motor 232 drives the inner shaft 214 for rotation about its axis at a high speed. The second motor 232 is mounted on the mounting plate 234 with its output shaft directed downwardly. A pulley 240 is connected to the output of the second motor 232, and another pulley 241 is mounted around the lower end of the inner shaft 214. A belt 242 extends around these two pulleys 240 and 241 so that the rotation of the second motor 232 is transmitted to the inner shaft 214. The two pulleys 240 and 241 and the belt 242 constitute a rotation-transmission means 239. The belt 242 is made of rubber and is strechable, and the belt 242 is prevented by a pair of pins 243 from being disengaged from the pulleys 240 and 241.

The operation of the apparatus will now be described.

Before initiating the operation, the height of the grinding element 123 of the grinding unit 101 as well as the height of the polishing film 224 of the finishing unit 201 is determined.

The dial gauge 59 is attached to the intermediate mounting portion 62, and the dial gauge 59 is indexed to the position above the mounting-reference member 60 by rotatably indexing the index plate 9. A probe of the dial gauge 59 is brought into contact with the upper end of the mounting-reference member 60, and this probe is fixed at this height or level. Then, the dial gauge 59 is indexed to the position above the grinding unit 101, and the probe of the dial gauge 59 is moved upwardly by an amount corresponding to the amount (for example, 10 μm) of grinding to be effected. Then, the grinding unit 101 is set at the spark-out position, and the grinding element 123 is moved upwardly until it is brought into contact with the probe of the dial gauge 59. This spark-out position can be sensed by the relation between the position sensor 136 and the dog 137. This height adjustment is carried out by loosening the set screw 134 and rotating the fixed shaft 131 to vertically move the grinding element 123 through the threaded connection. The shaft 128 is set at a predetermined height at this height adjusting position, and therefore when the fixed shaft 131 is moved vertically relative to the hollow shaft 108, the hollow shaft 108 is either moved upwardly against the bias of the springs 141 or moved downwardly under the influence of the springs 141. In this manner, the inner shaft 110 is moved together with the hollow shaft 108, so that the upper surface of the grinding element 123 on the upper end of the inner shaft 110 becomes higher than the mounting-reference member 60 by an amount corresponding to the amount of grinding to be effected. The upper surface of the grinding element 123 serving as the grinding surface is disposed at a height or level at which the processed end face of each optical fiber connector 2 is to be disposed. Then, the hollow shaft 108 is so set as to be ready to operate from the original position (the rotation angle of 0° ) through the relation between the original-position sensor 135 and the dog 137.

Also, for setting the height of the polishing film 224, the dial gauge 59 is indexed to the position above the finishing unit 201, and the roller 210 is received in the recess in the cam 56 to engage the support plate 209 with the abutment 246. Then, the probe of the dial gauge 59 is moved upwardly by a predetermined amount, and the abutment 246 for setting the height of the finishing surface is rotated to move the frame 202 upwardly to bring the upper surface of the polishing film 224 into contact with the probe of the dial gauge 59, thereby setting the height of the polishing film 224. After the above height-adjusting operations are completed, the dial gauge 59 is removed from the intermediate mounting portion 62, and instead the plug 67 is attached to the intermediate mounting portion 62.

After the above settings are completed, the end face processing apparatus 1 is ready to start its processing operation. During this processing operation, the axial rotation-imparting motor 25 is continuously rotated reciprocally to impart a reciprocal axial rotation, for example, of 400° to the chucks 4 via the gears 26 and 27, the transmission shaft 10, the drive gear 42, the intermediate gear 43, the clutches 49 and 50, the intermediate gear 44 and the driven gear 35. On the other hand, the index motor 17 imparts two rotations to the Geneva drive plate 13 to rotate the Geneva wheel 12 by an angle of 120°, so that the rotary index shaft 3 is intermittently rotated by the same angle together with the index plate 9 integrally connected to the index shaft 3, thereby indexing each of the three chucks 4 sequentially to the work mounting and removal position, the grinding position and the finishing position. When the Geneva drive plate 13 starts its rotation, the roller 21 comes into contact with the bulged portion of the cam 19, so that the positioning lever 20 is pivotally moved about the pivot pin 22 in a direction away from the Geneva wheel 12 to allow the rotation of the Geneva wheel 12, and after the indexing is completed, the positioning lever 20 is returned to its original position and is engaged in the groove in the Geneva wheel 12 to accurately maintain the indexed condition. When the position lever 20 is held away from the the Geneva wheel 12, with the roller 14 disengaged from the groove in the Geneva wheel 12, the arcuate projection 16 is disposed in registry with the arcuate recess 15. Therefore, during that time, the Geneva wheel 12 is prevented from freely rotating. In the above indexing operation, during the time when the index plate 9 makes one rotation, one chuck 4 moves from the work mounting and removal position through the grinding position to the finishing position and is returned to the work mounting and removal position.

When one chuck 4 is indexed to the work mounting and removal position, the rotation of the axial rotation-imparting motor 25 ceases to be transmitted to this chuck 4, disposed in the work mounting and removal position, through the operation of the clutches 49 and 50. More specifically, when the chuck 4 is indexed to the work mounting and removal position, the cam roller 51 on the clutch shaft 45 moves onto the raised portion of the first cam 55, so that the clutch shaft 45 moves upwardly against the bias of the spring 54, as shown in FIGS. 4 and 5. As a result, the upper clutch 49 is disengaged from the lower clutch 50 to interrupt the transmission of the rotation, and therefore the intermediate gear 44 and the driven gear 35 in mesh therewith remain stationary. When the clutch shaft 45 thus moves upwardly, the pin plate 53 moves upwardly therewith to bring each of the pins 58 between the adjacent teeth of the intermediate gear 44, so that the driven gear 35 and the chuck 4 integrally connected therewith are positively prevented from rotation.

Then, the thumb piece 37 is loosened, and the collet 34 is moved upwardly so that the upper portion of the collet 34 is radially expanded. Then, the optical fiber connector 2 to be processed is inserted into the collet 34 in such a manner that its lower end face to be processed is held against the upper end of the mounting-reference member 56. Then, the thumb piece 37 is rotated in its tightening direction to radically contract the lower end portion of the collet 34, so that the optical fiber connector 2 is adjusted in height within the collet 34 and is held in a vertical condition. Thereafter, during the time when the chuck 4 with the optical fiber connector 2 is moved to the next position (the grinding position), the clutch shaft 45 moves downwardly, so that the chuck 4 repeats the reciprocal rotation and is positioned in opposed relation to the grinding element 123 with the predetermined spacing therebetween.

When the motors 142 and 143 are rotated for the grinding operation, the rotation of the axial rotation-imparting motor 143 is transmitted to the inner shaft 110 through the pulleys 148 and 149 and the belt 150 so that the shaft 110 is rotated at a relatively high speed together with the grinding element 123. Thus, the grinding element 123 is rotated about its axis. On the other hand, the rotation of the motor 142 is reduced by the speed reducer 145 and is transmitted to the hollow shaft 108 through the gear 146 and the gear 116 so that the hollow shaft 108 makes one rotation (for example, 1 r.p.m.) about its axis per cycle of the processing. As a result, the inner shaft 110 revolves around the axis of the hollow shaft 108. The circle, generated by the axis of the inner shaft 110 during its revolution, has a radius equal to the amount E1 of eccentricity. Therefore, during the grinding operation, the ground surface of the optical fiber connector 2 is displaced in the direction of the width of the grinding surface of the grinding element 123 by an amount equal to the amount of eccentricity so that the ground surface of the optical fiber connector 2 is uniformly brought into the entire grinding surface of the grinding element 123 without causing a localized abrasion. When the hollow shaft 108 is rotated from the rotation angle of 0° to the rotation angle of 360°, the cam roller 129 held in contact with the stationary cam 127 is upwardly moved or displaced sequentially in the order of the rapid feed, the processing, the finishing and the spark-out to thereby move or displace the hollow shaft 108 and the inner shaft 110 upwardly. Therefore, the grinding element 123 is brought into contact with the lower face of the optical fiber connector 2 at the processing step after the rapid feed step, and subsequently the finishing step and the spark-out step are carried out. After the spark-out step, the cam roller 129 is brought into contact with the rapid return portion of the stationary cam 127, and therefore the cam roller 129 descends, so that the grinding element 123 is moved away from the lower face of the optical fiber connector 2 disposed at a predetermined height or level, thus completing the grinding operation.

As described above, after one rotation of the hollow shaft 108, the dog 137 is again disposed in registry with the original-position sensor 135, so that this sensor 135 feeds a sensing signal to a controller (not shown) whereupon the revolution-imparting motor 142 and the axial rotation-imparting motor 143 are automatically stopped under the control of the controller.

In the above sequential steps of the grinding operation, the optical fiber connector 2 is held in a vertical condition, and the upper surface of the grinding element 123 is inclined with respect to a horizontal plane at a predetermined angle by virtue of the provision of the tapered annular washer 104. The optical fiber connector 2 is repeatedly rotated reciprocally about its axis in the range of 400°. Therefore, the ground surface of the optical fiber connector 2 has a conical shape as shown in FIG. 15. A desired apex angle of this conical shape can be obtained by adjusting the angle of inclination of the grinding element 123. Alternatively, such a conical shape can also be obtained by disposing the grinding element 123 in a horizontal condition and inclining the optical fiber connector 2 relative to the vertical line at a preselected angle.

The motor-mounting member 147 is prevented by the shaft 153 from rotation, and therefore does not revolve around the hollow shaft 108 even when the hollow shaft 108 is rotated. However, the lower portion of the hollow shaft 108, on which the motor-mounting member 147 is mounted through the bearings 151, has the axis common to the axis of the inner shaft 110, and therefore the end portion of the motor-mounting member 147 mounted on the hollow shaft 108 is horizontally moved along an orbit of revolution of the inner shaft 110 around the axis of the hollow shaft 108 when the hollow shaft 108 is rotated, and at this time the motor-mounting member 147 is swingingly moved about the shaft 153 and is displaced along the slot 152.

After the above grinding operation is completed, the optical fiber connector 2 subjected to the grinding is then indexed to the finishing position. Before the chuck 4 holding the optical fiber connector 2 is indexed to the finishing position, the roller 210 in contact with the lower edge of the second cam 56 is kept lowered, and therefore the frame 202 is spaced from the lower end of the abutment 246 an held in a lower position. When the chuck 4 is indexed to the finishing position, the roller 210 is received in the recess in the cam 56, and the frame 202 is moved upwardly by the springs 207 to bring the support plate 209 into engagement with the abutment 246. As a result, the polishing film 224 of the abrasive unit 220 is brought into contact with the lower end face of the optical fiber connector 2 under a predetermined force.

In this condition, when the first and second motors 231 and 232 are rotated, the optical fiber connector 2 is polished by the polishing film 224. More specifically, the rotation of the first motor 231 is transmitted via the rotation-transmission means 236 to the hollow shaft 212 so that the hollow shaft 212 is rotated at a low speed (for example, 20 r.p.m. Therefore, the hollow shaft 212 causes the inner shaft 214 to revolve around the axis of the hollow shaft 212 because of the eccentricity of the inner shaft 214 from the hollow shaft 212. On the other hand, the rotation of the second motor 232 is transmitted via the rotation-transmission means 239 to the inner shaft 214, so that the abrasive unit 220 mounted on the upper end of the inner shaft 214 is rotated at a high speed (for example, 1500 r.p.m.). Thus, the abrasive unit 220 revolves around the axis of the hollow shaft 212 at a low speed and also rotates about its axis at a high speed. Therefore., there is provided a relative movement between the optical fiber connector 2 and the polishing film 224 of the abrasive unit 220, shown in FIG. 16. During this revolution, the distance between the axis of the output shaft of the second motor 232 and the axis of the inner shaft 214 varies in the range of the amount twice the amount E2 of eccentricity. This variation is absorbed by the expansion and contraction of the the strechable belt 242, and the amount E2 of eccentricity of the inner shaft 214 is naturally determined to such an extent that the belt 242 is allowed to suitably expanded and contracted. During this polishing or abrasive operation, the abrasive liquid is applied to the upper surface of the polishing film 224. This abrasive liquid is scattered by the rotation of the abrasive unit 220, and impinges on the inner surface of the cover 228, and drops into the pan 222. Then, the abrasive liquid is discharged from an outlet of the pan 222 and is fed to a predetermined location. During this polishing operation, the optical fiber connector 2 is reciprocally rotated so that the end face of the optical fiber connector is finished or polished radially outwardly from the axis thereof into the same condition.

When the above finishing is completed, the chuck 4 holding the thus finished optical fiber connector 2 is returned to the work-mounting and removal position, and the thus processed optical fiber connector 2 is removed from the chuck 4, and instead a fresh optical fiber connector 2 to be processed is attached to this chuck 4.

As described above, during one rotation of the index plate 9, each optical fiber connector 2 undergoes the grinding and the finishing sequentially, and the optical fiber connectors 2 are continuously processed.

When the grinding element 123 needs a dressing operation, the plug 62 is removed from the intermediate mounting portion 62, and instead the dresser 64 is attached to the intermediate mounting portion 62 so as to dress the upper surface of the grinding element 123. When the polishing film 224 needs to be replaced by a new one, the plug 67 is removed from the descending jig-mounting portion 63, and instead the descending jig 68 is attached thereto. By descending a handle of the jig 68 to move the frame 202 downwardly to provide a space between the index plate 9 and the abrasive unit 220. Then, the new polishing film 224 is attached to the abrasive unit 220.

In the above embodiment, although the axial rotation-imparting motor 25 and the index mechanism are disposed at levels lower than the rotary index shaft 3, these may be disposed at a level higher than the index shaft 3. Also, the grinding unit 101 and the finishing unit 201 are not restricted to the exact showings thereof in the above embodiment. For example, the grinding element 123 as well as the polishing film 224 may not revolve so that it can only rotate about its axis at a high speed. Also, the grinding wheel 123 may be disposed in a horizontal plane.

The rotation-transmission means 239 of the finishing unit 201 in the form of a belt-and-pulley arrangement may be replaced by a modified rotation-transmission means **239*a* (FIG. 17) which comprises gears 244 and 245, like the rotation-transmission means 236. In this modified form of the invention, the second motor 232 is secured directly to the lower end of the frame 202 in such a manner that the axis of the output shaft of the second motor 232 coincides with the axis of rotation of the hollow shaft 214. The gear 244 is mounted on the output shaft of the second motor 232, and the gear 245 is mounted on the inner shaft 214 and is in mesh with the gear 244. The amount E3 of eccentricity of the inner shaft 214 relative to the hollow shaft 208 is equal to the sum of the radii of the gears 244 and 245. With this arrangement, the amount E3 of eccentricity can be made greater than that in the above embodiment shown in FIGS. 13 and 14. The other portions or parts are the same as those in the above embodiment. In this modified form of the invention, during the polishing operation, the hollow shaft 212 is driven by the first motor 231 for rotation as in the above embodiment of FIGS. 13 and 14, and the inner shaft 214 revolves around the output shaft of the second motor 232 and also is rotated about its axis by the second motor 232 through the gears 244 and 245**.

The following advantages can be achieved with the end face processing apparatus 1:

The plurality of chucks 4 are mounted on the rotary index shaft 3, so that each chuck 4 is sequentially indexed to the mounting-reference member 60, the grinding unit 101 and the finishing unit 202 in this order. Therefore, the attachment and detachment of the optical fiber connector 2 relative to the chuck 4, the grinding operation and the finishing operation can be carried out continuously, and these three operations can be carried out at the same time. Thus, the processing operation can be conducted quite efficiently.

The driving force for reciprocally rotating each chuck 4 is transmitted thereto through the gear train disposed between the center of the rotary index shaft 3 and the chuck 4. Therefore, the necessary reciprocal rotation of the chuck 4 is continuously obtained regardless of the indexing operation.

When the chuck 4 is indexed to the work mounting and removal position, the clutches 49 and 50 incorporated in the gear train are disengaged to positively stop the rotation of the chuck 4. This facilitates the attachment and detachment of the optical fiber connector relative to the chuck 4 when the optical fiber connectors 2 held by the other chucks are subjected to the grinding and finishing operations, respectively. Further, since the reciprocal rotation is imparted to the chuck through the gear train, such rotation transmission means can more positively transmit the required reciprocal rotation to the chuck 4 as compared with the conventional friction transmission means. This enhances the precision of the processed end face of the optical fiber connector.

What is claimed is:

1. Apparatus for processing an end face of an optical fiber connector comprising:

(a) a rotatable index shaft mounted on a frame;

(b) a mounting-reference member disposed at a first index position for providing a reference for mounting the optical fiber connector;

(c) a grinding unit disposed at a second index position for grinding the end face of the optical fiber connector;

(d) a finishing unit disposed at a third index position for finishing the end face of the optical fiber connector;

(e) a plurality of chucks for holding optical fiber connectors, respectively, said chucks being mounted on said index shaft so that each chuck can be moved sequentially from one of said indexed positions to another, and each said chuck being rotatable together with the optical fiber connector;

(f) a rotatable drive gear disposed coaxially with said index shaft;

(g) a driven gear fixedly mounted on each said chuck;

(h) a pair of first and second intermediate gears connected to said drive and driven gears, respectively;

(i) a clutch means interposed between said pair of intermediate gears and normally connecting them together to transmit the rotation of said drive gear to said driven gear to rotate said each chuck; and (j) a clutch disengagement means for disengaging said clutch means to disconnect said two intermediate gears when said each chuck is indexed to said first index position.

2. Apparatus according to claim 1, in which said pair of intermediate gears are disposed in opposed relation to each other and have coacting clutch portions at their opposed surfaces, said clutch portions constituting said clutch means and normally being coupled together, there being provided a cam for disengaging one of said two clutch portions from the other.

3. Apparatus according to claim 2, in which an axially-movable clutch shaft is mounted on said index shaft, said first intermediate gear being mounted on said clutch shaft for movement therewith, said cam being disposed in contact with said clutch shaft so as to axially move the same together with said first intermediate gear so that said coacting clutch portions can be disengaged from each other.

4. Apparatus according to claim 3, in which a rotation-preventing pin is mounted on said clutch shaft for movement therewith so that when said clutch shaft is axially moved so as to disengage said coating clutch portions from each other, said rotation-preventing pin is engaged with said second intermediate gear to positively hold the same against rotation.

5. Apparatus according to claim 1, in which said finishing unit comprises (i) a hollow shaft mounted on said frame for rotation about its axis and having an axial bore therethrough; (ii) an inner shaft extending through said bore of said hollow shaft in eccentric relation to said hollow shaft and supported by said hollow shaft for rotation about the axis thereof; (iii) an abrasive unit fixedly mounted on one end of said inner shaft so as to polish the end face of the optical fiber connector; (iv) a first motor mounted on said frame for rotating said hollow shaft about its axis so as to revolve said inner shaft about the axis of said hollow shaft; and (v) a second motor mounted on said frame for rotating said inner shaft about its axis so as to rotate said abrasive unit.

6. Apparatus according to claim 5, in which there is provided a first rotation transmission means which connects the output of said first motor to the outer periphery of said hollow shaft intermediate opposite ends of said hollow shaft so as to rotate said hollow shaft about its axis, there being provided a second rotation transmission means which connects the output of said second motor to the other end of said inner shaft so as to rotate said inner shaft about its axis.

7. Apparatus according to claim 6, in which said second motor has an output shaft disposed coaxially with said hollow shaft, said second rotation transmission means comprising a first gear fixedly mounted coaxially on said output shaft of said second motor, and a second gear fixedly mounted coaxially on the other end of said inner shaft and meshing engaging said first gear.

8. A apparatus according to claim 5, in which a cam means is provided for bringing said abrasive unit into contact with the end face of the optical fiber connector when each said chuck is indexed to said third index position.

9. Apparatus according to claim 1, in which said grinding unit comprises (i) a hollow shaft mounted on said frame for rotation about its axis and having an axial bore therethrough; (ii) an inner shaft extending through said bore of said hollow shaft in eccentric relation to said hollow shaft and supported by said hollow shaft for rotation about the axis thereof; (iii) a grinding element fixedly mounted on one end of said inner shaft so as to grind the end face of the optical fiber connector; (iv) a first motor for rotating said hollow shaft about its axis so as to revolve said inner shaft about the axis of said hollow shaft; and (v) a second motor for rotating said inner shaft about its axis so as to rotate said grinding element.

10. Apparatus according to claim 9, in which a tubular support member is mounted on said frame for movement along its axis, said hollow shaft being received in and supported by said support member for rotation about its axis in such a manner that said hollow shaft is prevented from axial movement relative to said support ember, there being provided urging means for urging said support member in a direction away from the optical fiber connector, there being provided a cam fixed relative to said frame, one end of said hollow shaft remote from the optical fiber connector being held in contact with said cam under the influence of said urging means so as to move said hollow shaft along its axis toward and away from the optical fiber connector when said hollow shaft rotates about its axis, said first motor being fixed relative to said frame, and said second motor being supported on said hollow shaft in a manner to allow the rotation of said hollow shaft.

11. Apparatus according to claim 9, in which the optical fiber connector is disposed vertically, said grinding element having a grinding surface which is disposed in a plane inclined at a predetermined angle relative to a horizontal plane.

* * * * *